United States Patent [19]

Goodwin

[11] 4,111,426

[45] Sep. 5, 1978

[54] GOLF CLUB SWING TRAINING DEVICE

[76] Inventor: Elwood Goodwin, 1245 Brittany Cir., Colorado Springs, Colo. 80907

[21] Appl. No.: 786,599

[22] Filed: Apr. 11, 1977

[51] Int. Cl.[2] ..... A63B 69/36

[52] U.S. Cl. ..... 273/186 C; 273/80.1; 273/167 C; 273/195 A; 273/192; 273/168

[58] Field of Search ..... 273/186 C, 186 R, 79, 273/176 J, 80.1, 167 C, 167 B, 195 A, 192, 193 R, 193 B, 194 R

[56] References Cited

U.S. PATENT DOCUMENTS

| | | | |
|---|---|---|---|
| 1,643,250 | 9/1927 | Longsworth | 273/79 |
| 1,732,574 | 10/1929 | Brown et al. | 273/176 J |
| 3,885,796 | 5/1975 | King | 273/186 C |

*Primary Examiner*—George J. Marlo
*Attorney, Agent, or Firm*—Richard D. Law

[57] ABSTRACT

A device for training an individual's putting game including a channel shaped guide member having an adjustable width, straight channel therein which extends the entire length thereof and which is open along its upper face and both ends thereof so as to reciprocally receive the head of a putter. The width of the channel is adjustable from a relatively loose fit with the putter head to a snug fit. The putter having a head of a predetermined width and a shaft which is angularly adjustable with respect to the head, and which may be adjusted and locked with repsect to the head by a user in a normal putting stance.

1 Claim, 7 Drawing Figures

GOLF CLUB SWING TRAINING DEVICE

BACKGROUND OF THE INVENTION

This invention relates to a golf training device, and more particularly to a putting trainer arranged to train a golfer to achieve a putting stroke which is straight and unwavering so as to strike a ball and propel it on a desired course.

In order to master the game of golf, every phase of the game and the use of every golf club pertaining to each phase of the game must be mastered. No phase is more important than putting, nor any club more important to master than the putter. Many a golf game have been won or lost solely due to the putting proficiency of a player. On a par 72 course, for example, greens are counted for a two putt, so one-half of the strokes are putts.

In light of this, there have been attempts by the prior art to train both an individual's golf swing and his (her) putting stroke. Each of several prior art devices utilizes a putter with an angularly adjustable shaft which is adjustable only by loosening and tightening a wing nut on a bolt which attaches the putter head to the shaft. Therefore, for a player to adjust the putter shaft to his (her) own peculiar physique and style, he (she) must engage in a trial and error procedure of loosening the wing nut, adjusting the shaft to a certain angle, tightening the wing nut and holding and stroking the putter within the training device to determine if the putter is properly adjusted. Therefore, it can be seen that a certain amount of time and frustration is involved in utilizing such prior art trainers which detracts from the patience and practice time necessary to improve an individual's putting stroke.

There have been several attempts in the prior art to devise a practical adjustable golf club. Note, for example, U.S. Pat. Nos. 2,027,452 and 3,214,170.

SUMMARY OF THE INVENTION

This invention relates to a device for training an individual's putting stroke which comprises a guide member having an adjustable width, straight channel therein which extends the entire length thereof and which is open along one face of the guide member and both ends thereof so as to receive the head of the putter. The bottom of the channel is lined with an artificial surface which simulates the surface of a putting green. The width of the channel is adjustable from a loose fit with the putter head for the golf novice, to a width which provides a fit wherein the putter head barely fits within the channel for the more advanced golfer. The putter comprises the putter head of a predetermined width and a shaft which is angularly adjustable with respect to the head in the direction along or parallel to the longitudinal axis thereof and which may be adjusted and locked with respect to the head by manual manipulation of the shaft while the user is in a normal putting stance.

It is an object of the present invention to provide an improved putting trainer device to enable an individual to develop a smooth and accurate stroke.

It is a further object of the present invention to provide a putting trainer device which is constructed of relatively few parts and therefore is reliable and can be economically manufactured.

Still a further feature of this invention is to provide an improved shaft locking mechanism which is controlled by manual manipulation of the shaft, thereby eliminating the need to break one's putting stance or to raise the putter head out of the channel to angularly adjust the putter shaft.

BRIEF DESCRIPTION OF THE DRAWINGS

In the accompanying drawings of various illustrative and presently preferred embodiments of the invention, and in which like reference numerals are employed to designate like parts.

DETAILED DESCRIPTION

Figure 1:
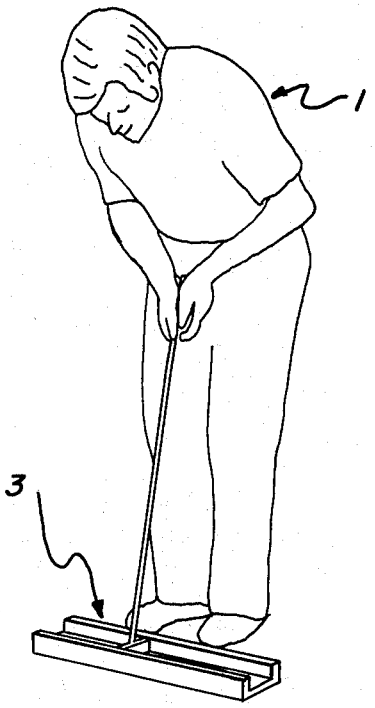
FIG. 1 is a perspective view of an individual using the training device of the present invention.
Figure 2:
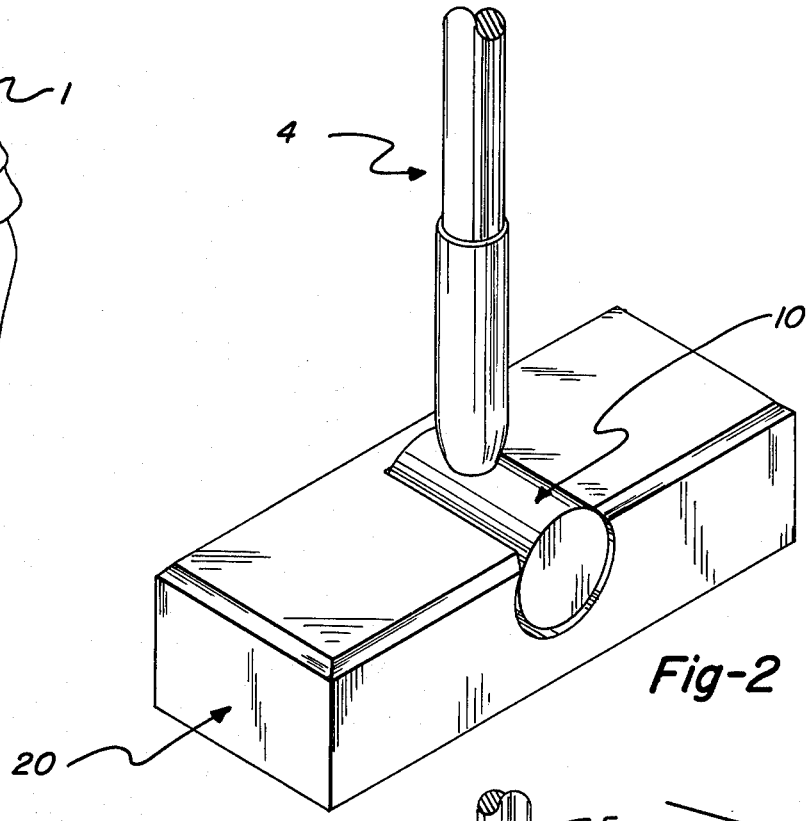
FIG. 2 is a partial perspective view of the putter head, shaft and locking mechanism of the present invention fully assembled.
Figure 3:
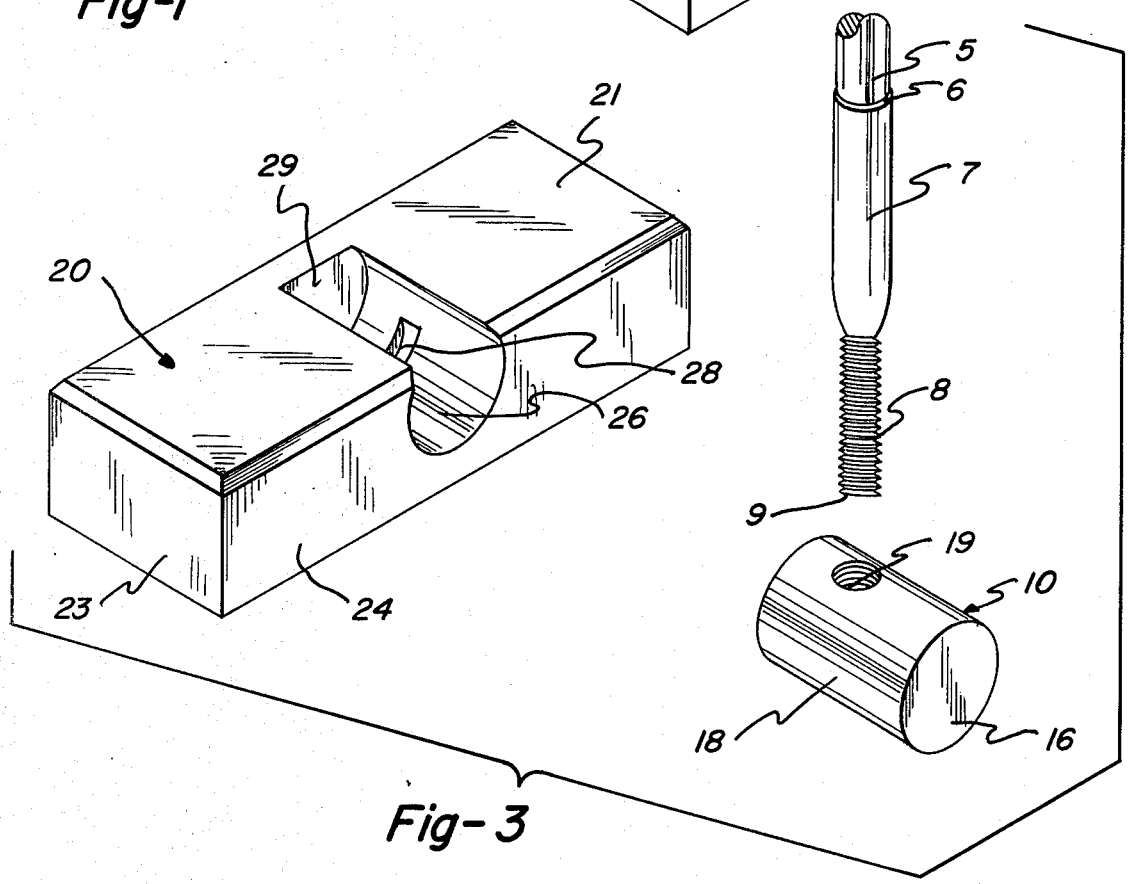
FIG. 3 is a partial, exploded perspective view of the putter head, shaft and locking mechanism of the present invention.
Figure 4:
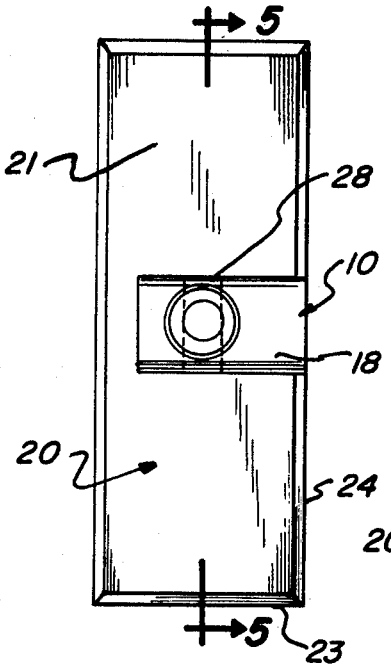
FIG. 4 is a top plan view of a putter training device of the present invention.
Figure 5:
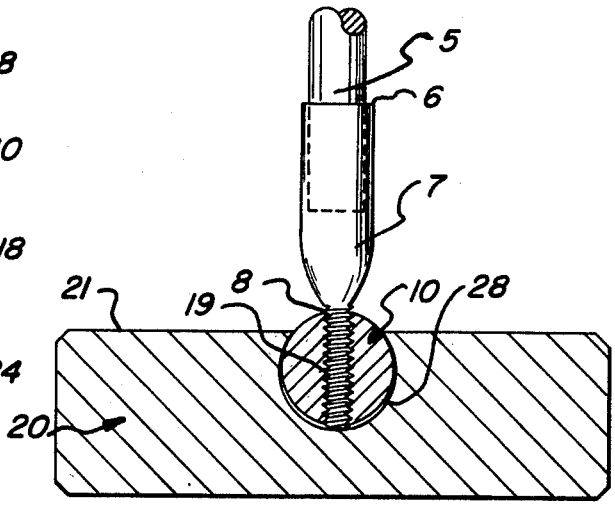
FIG. 5 is a partial cross sectional elevation view of the present invention taken along line 5—5 of FIG. 4.

Referring now to FIGS. 1–5, there is shown a golfer 1 utilizing a preferred embodiment of a putter of the training device of the present invention, illustrated generally at 3. The putter of the training device shown generally, comprises an angularly adjustable shaft portion 4, a pivotable, lockable cylinder 10, and a putter head 20. The shaft further comprises an elongated cylindrical rod member which may be a hollow, one piece rod member or may be of a telescoping variety so as to provide for an adjustable length to suit the peculiar physique of an individual golfer. The shaft terminates at its uppermost end in a conventional handgrip portion, not shown, manual manipulation of which, as later described, allows for angular adjustment of the shaft. At its lower end, the shaft end is enclosed in a collar 7 of somewhat increased diameter, having a shoulder 6 and tapering at its opposite end to a threaded portion 8. The shaft terminates in a relatively rounded, blunt end 9. The pivotable, lockable cylinder, shown generally at 10, is generally a right cylinder and comprises a substantially round outer cylindrical surface 18, end portions 16 and a radially diverted, threaded female bore 19 which may be positioned at any location along the outer cylindrical surface of lockable cylinder as desired to simulate any particular type of putter. The putter head 20 is generally a parallelepiped; the block shape comprises a top surface 21, a bottom surface, not shown, which corresponds to the top surface in its peripheral configuration, end surfaces 23 and side surfaces 24, said side surfaces lying in a plane parallel to the longitudinal axis plane of the putter head. The intersecting edges between the top surface and the end surfaces and between the top surface and the side surfaces may be chamfered. The putter head is further provided with a truncated cylindrical bore arranged with an open side in the top surface 21. The bore is slightly larger than the rotatable locking cylinder so as to receive said cylinder in relatively loose fitting relationship, to allow for rotation of the locking cylinder therein. The axis of the bore is parallel to the end surfaces 23 and may be located anywhere between the two end surfaces as desired, to simulate any particular type of putter. The bore is drilled from one side surface 24, but does not penetrate the other side surface, thereby forming a bore end 29. In addition, the bore is drilled eccentric with respect to side surface 24, thereby intersecing the top surface 21 and forming an opening in top surface 21. Thus, when the rotatable, lockable cylinder is inserted into the truncated cylindrical bore, a portion of the cylinder extends vertically above the top surface 21. This permits the threaded lower portion 8 of the shaft to be mated with and extend through the female bore 19 of the rotatable locking cylinder. The lower portion of the truncated cylindrical bore is provided with a groove 28 which extends in a plane parallel to side surfaces 24 and which is sized to receive the relatively rounded, blunt lower end 9 of the shaft 4, as will be hereinafter described. The arc of groove 28 in surface 26 is defined by the arc scribed by blunt lower end 9 of the shaft (when threaded through the locking cylinder) as the shaft is rotated in each of the two permissible directions until the collar 7 of the shaft abuts an edge of the groove in the top surface 21, as is best illustrated in FIG. 5.

Figure 6:
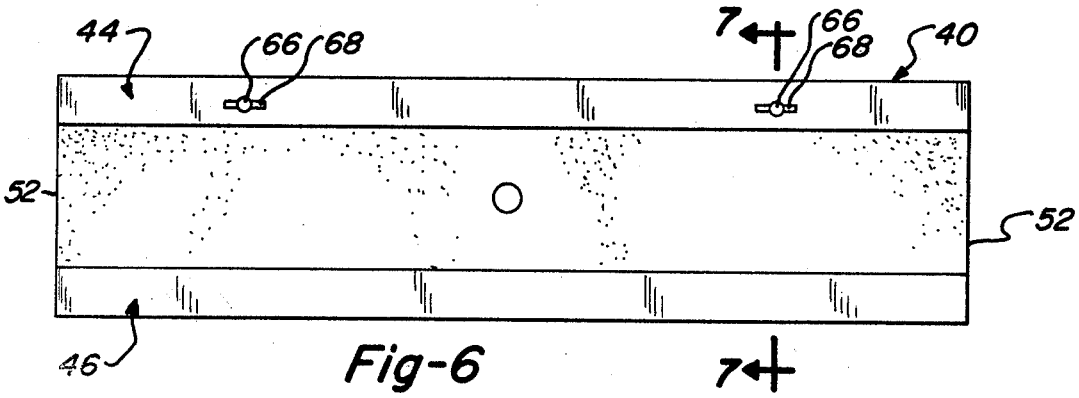
FIG. 6 is a top plan view of the guide member of the training device of the present invention.
Figure 7:
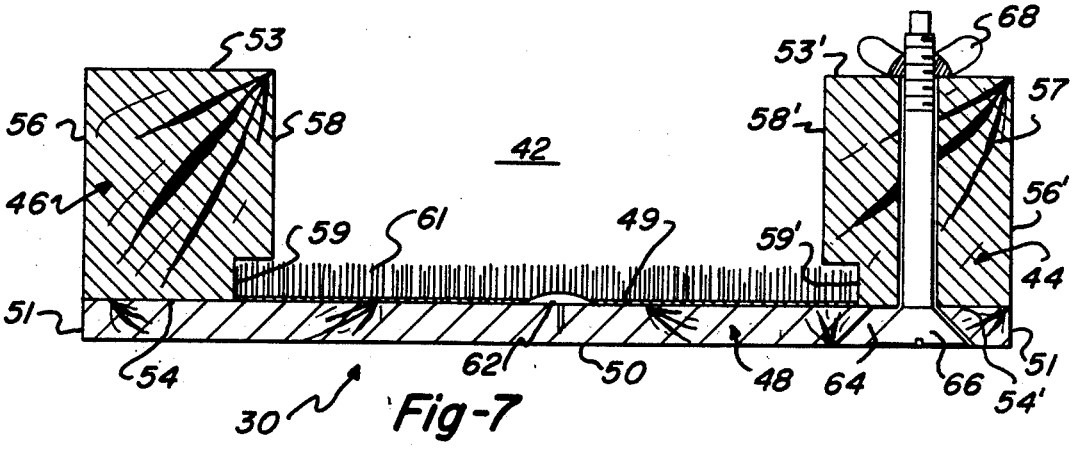
FIG. 7 is a cross sectional view of the guide member of the training device of the present invention taken along line 7—7 of FIG. 6.

Now referring to FIGS. 6 and 7, the guide member of the present invention is shown generally at 40, and comprises an adjustable width, straight channel 42 which extends the entire length thereof and which is open along the top of the guide member and to both ends thereof to receive the putter head 20. The guide member further comprises, and the channel 42 is defined by, a flat bottom plate 48 and a pair of parallel side rails 44 and 46. The flat bottom plate is composed of a flat top surface 49, a flat bottom surface 50 having a peripheral configuration substantially identical to the flat top surface, opposed parallel and edges 52 and opposed parallel side edges 51. The side rails 44 and 46 extend the entire length of the flat bottom plate and are identical in their cross-sectional configuration. Side rail 46 has a top edge 53, a bottom edge 54, back surface 56, and a flat, vertical interior surface 58. Side rail 44 has similar surfaces as 53', 54', 56', 58', and 59'. The notches 59 and 59' may extend the entire length of the flat vertical interior surfaces. An artificial surface 61, simulating the grass surface of a putting green such as, for example, a synthetic plastic, is provided along the entire length of the flat top surface 49, and is sized in width to snugly fit within groove 59 and 59' along the entire length thereof. The artificial surface is further attached to the flat top surface 49 by any conventional means, such as, for example, the tacks 62 illustrated in FIG. 7. The side rails 44 and 46 are aligned longitudinally with the longitudinal axis of the base and define the sides of the channel 42 included therebetween.

One side rail 46 is fixedly secured to the flat bottom plate 48 such that the flat vertical back surface 56 of the side rail is vertically aligned with one of the side edges 51 of the flat bottom plate. The other side rail 44 is laterally movable. Any suitable means may be employed to render such side rail movable such as, for example, the embodiment shown in FIGS. 6 and 7 wherein side rail 44 has a plurality of vertical bores 57 therethrough which are spaced in a predetermined sequence. The flat bottom plate 48 has a plurality of slots 64 which transversely extend toward side rail 46 and vertically correspond to the vertical bores through side rail 44, the slots being countersunk from the flat bottom surface 50 of the flat bottom plate. Conventional screws 66 are inserted through the slots from the flat bottom surface 50, through the vertical bores 57 in the side rail 44 and the threaded portion thereof extends above the top edge 53 of the side rail 44. A wing nut 68 is mated with the threaded portion of the screw which extends above the top edge 53, so as to secure the side rail 44 in a desired position. The wing nuts may be loosened so that the side rail 44 can be moved transversely of the base in a direction toward or away from the other side rail 46 as is permitted by the length of the slots 64. Any other suitable alternative embodiment may be utilized to move side rail 44 laterally such as, for example, a rack and pinion structure (not shown). The movable rail is, generally, infrequently moved and the wing nuts are not too inconvenient. Also, they permit accurate parallel alignment with the fixed rail.

It is important to note that even when side rail 44 is moved laterally away from side rail 46 as far as is permitted the putter may be moved freely. However, the leeway between the end surfaces of the putter head and the rails is such that upon canting the putter head in the channel, the corners of the putter head contact the interior rail surfaces, causing the putter head to wedge within the channel. Thus,it is a training device to teach a straight swing without twisting a putter head.

In operation of the training device of the present invention, the individual golfer 1 first adjusts the length of the shaft, if the shaft is of the telescoping embodiment. Next the golfer 1, assumes a putting stance and adjusts the angular position of the shaft with respect to the putter head in a direction along or parallel to the longitudinal axis of the putter head to suit his own peculiar physique, with the lower surface of the putter head being parallel to the putting surface. This angular adjustment of the shaft is accomplished by turning the shaft and does not require the golfer to break his putting stance. In particular, when the putter of the present invention is in a fully assembled, locked position, i.e., when the blunt end 9 of the shaft is wedged in groove 28, the shaft is twisted thereby wedging the putter head within the channel. The hand grip portion of the shaft 4 (not shown) may be manually rotated so as to back the shaft out of the bore 19 thereby disengaging the blunt lower end 9 from the groove 28. Once this disengagement occurs, the golfer angularly adjusts the shaft with respect to the putter head, such adjustment being limited only by the abutment of the shaft with the slot edge. When the golfer has found a suitable angle for the shaft, the shaft is rotated to tighten the shaft in the bore 19 until the lower end 9 wedges in the groove 28. In this position, the threads of the lower portion 8 act upwardly against the threads of bore 19 forcing the outer cylindrical surfaces 18 to abut the top surface of bore 26 thereby creating a wedged, locked effect. The shaft is laterally retained within the putting head by the sides of groove 28 acting against the blunt lower end 9. The wedging action of the vertical surfaces of the side rails against the end surfaces of the putter head serves to hold the putter head stationary while this angular adjustment of the shaft takes place. Once the adjustment is complete, the putter head is manually released from its wedged position.

After the final adjustment of the putter, the side rail 44 of the guide member is initially adjusted so as to provide for the maximum width of channel 42. Once a proper stance is assumed, the golfer practices a putting stroke by moving the putter head across the artificial surface 61 between the end wedges 52 while maintaining the putter head between the side rails 44 and 46. The putter head must be maintained in a normal fashion with respect to the ball to be stroked and the ball must be struck by the center of the putter head as is conventional procedure in order to propel the ball on a desired straight course. After the golfer has become proficient at putting with the side rails providing for a maximum channel width the side rail 44 is moved toward the other side rail, in the embodiment illustrated, by loosening wing nuts 68, moving the side rail laterally the desired amount and tightening wing nut 68 on screw 66 to properly secure the side rail in position. Eventually the golfer will move the side rail 44 laterally as far as the slots 64 will permit. In this position the channel 42 is at its narrowest width with only a very small amount of clearance between each end surface of the putter head and the side rail adjacent thereto. During the putting stroke only a slight turn of the putter head with respect to the normal will cause the putter head to contact the flat vertical interior surfaces of the side rails 58 and possibly to become wedged within the channel 42. If this occurs, it indicates that the golfer's stroke or grip of the shaft is not proper and it can be corrected accordingly.

Thus, the guide member serves to correct an errant putting stroke and produce a smooth, straight stroke which will propel a golf ball in a desired course. Further, the side rails 44 and 46 have a height such that when the putter head is lifted high off the ground during the putting stroke the putter head will be lifted out of the channel thereby eliminating any guidance afforded by the guide member and alerting the golfer so that he can cure this tendency on subsequent practice strokes.

While inventive concepts have been disclosed herein in reference to a presently preferred and illustrative embodiment of the invention, it is contemplated that those concepts may be variously employed and embodied in alternate structure. It is intended that the appended claims be construed to cover alternate embodiments of the inventive concepts except insofar as precluded by the prior art.

What is claimed is:

1. In a putter training device providing the combination of a channel-shaped guide member and putter arranged to move in a putter stroke in the guide member, the improvement of:

(a) the channel-shaped guide member having a flat bottom plate with flat top surface and flat bottom surface with parallel ends and parallel side edges, a fixed side rail depending normally to the top flat surface of the bottom plate at one edge of the member with its outer surface coinciding with said one edge and having an inner planar surface normal to the flat top surface and having a notch extending along the inner surface at its lower inside corner facing the top surface of the bottom plate and a movable side rail depending from the flat top surface of the bottom plate on the opposite edge of the bottom plate and movable toward and away from the fixed side rail, said movable side rail having an inner planar surface normal to said bottom plate and having a notch extending along its lower inside corner facing the top surface of said bottom plate; and a pair of spaced bores through said movable side rail from its top through its bottom, and a pair of slots in said bottom plate in mating communication with said pair of bores through the movable side rail, said slots extending longitudinally toward and away from said fixed side rail and being countersunk on the bottom surface of said bottom plate to support a screw head therein out of the plane of the bottom surface of the bottom plate; and a pair of screws extending through said slots and said movable side rail and beyond the top of said movable side rail with a wing nut mounted on each screw permitting adjustment of the movable side wall from its top surface; and an artificial surface, simulating grass secured to the top surface of said bottom plate, extending into both said notches in the side rail, whereby at maximum width adjustment said artificial surface extends into said notch in said movable side rail;

(b) a putter element with a parallelepiped head and a shaft, said head having parallel ends and parallel top and bottom surfaces arranged to move between said side rails of said guide member with said ends adjacent said rails, a truncated cylindrical bore in the top durface having an opening in the top surface of the head of a width less than the diameter of the cylindrical bore, a relatively deep slot in the wall of the cylindrical bore opposite the top opening accommodating the end of the threaded portion of said shaft, a cylinder with a slightly smaller diameter than said cylindrical bore freely rotatably mounted in said bore, therebeing a threaded bore passing through said cylinder, said putter shaft having a threaded lower end having a portion extending through said threaded bore in said cylinder with said extending end disposed in said slot, whereby said shaft is angularly adjustable to said head by turning to loosen the cylinder and permit pivoting of the shaft and to tighten the shaft to the head by reverse turning the shaft to frictionally wedge said cylinder in said head while the user of the putter is in putting stance with the putter head in the guide member.

* * * * *